US005454663A

United States Patent [19]

Stegmeier

[11] Patent Number: 5,454,663

[45] Date of Patent: Oct. 3, 1995

[54] REPLACEMENT RE-COVER DRAIN TOP FOR SWIMMING POOL DECK DRAIN

[76] Inventor: William J. Stegmeier, 3313 Ambassador Row, Arlington, Tex. 76013

[21] Appl. No.: 147,690

[22] Filed: Nov. 4, 1993

[51] Int. Cl.[6] ..... E01C 11/22

[52] U.S. Cl. ..... 404/2; 404/4; 52/169.5

[58] Field of Search ..... 404/2, 3, 4, 5; 52/169.5, 169.6, 169.7

[56] References Cited

U.S. PATENT DOCUMENTS

| | | | |
|---|---|---|---|
| 4,815,888 | 3/1989 | Stegmeier | 404/4 |
| 5,181,793 | 1/1993 | Dekel | 404/4 |

OTHER PUBLICATIONS

"Deck Drain"–Stegmeier Corp.
"Frontier Deck Drain" Stegmeier Corp.
"Drain Rite"–Mortex Mfg. Co., Inc.
"The Deck Drain–A–Way System"–Quaker Plastic Corp.
"Deck–O–Drain Mark II"–DFC.
"Micro Channel" NDS.
Stegmeier Corp.–1993 Dist. Price List p. 8–"Recover Strip".

*Primary Examiner*—Stephen J. Novosad
*Assistant Examiner*—Pamela A. O'Connor
*Attorney, Agent, or Firm*—Daniel Rubin

[57] ABSTRACT

A replacement re-cover drain top for a deteriorated top of an existing drain situated in the deck area about a swimming pool. The re-cover top is of a channel-like section and is adapted when installed to overlie an existing drain from which its previous top has been at least partially removed. Drain apertures in the top communicate with the drain on which it is installed from below the upper surface of the top to a depth corresponding at least to the flush level of the adjacent decking.

8 Claims, 2 Drawing Sheets

REPLACEMENT RE-COVER DRAIN TOP FOR SWIMMING POOL DECK DRAIN

FIELD OF THE INVENTION

The field of art to which the invention relates comprises drain apparatus commonly used about the decking areas surrounding a swimming pool.

BACKGROUND OF THE INVENTION

Drain units are widely used in and about the deck areas surrounding a swimming pool and are commonly formed of molded polyvinyl chloride (PVC) buried in the aggregate. Apertures formed in the upper exposed drain surface are generally flush with the grade of the adjacent decking for receipt of drain water. In that relation, the body of the drain remains buried in the decking while the upper top surface is continuously exposed to sunlight containing ultra violet light (U.V.). Over a period of years, the U.V. adversely affects the exposed plastic gradually causing the exposed surface to deteriorate to the point where repair eventually becomes necessary.

BACKGROUND OF THE PRIOR ART

PVC drain constructions for swimming pool deck areas are available from a variety of commercial sources and can comprise an integral unit such, as disclosed for example, in U.S. Pat. Nos. 3,876,322 and 4,490,067. Removable cover type units are also available, as for example disclosed in U.S. Pat. No. 4,815,888.

Where consisting of an integral unitary construction, repair is more complex in that it usually entails saw cutting and removing longitudinal center strips of the upper surface in which the drain apertures had previously been contained. With the center portion removed, a strip of replacement re-cover drain top containing surface drain apertures can be interfitted on or about the drain so as to provide a refurbished appearance while permitting the drain to function.

While seemingly enabling the drain to function as before, the imposition of the replacement drain top has the effect of elevating the surface of the drain above the adjacent decking surface equivalent to at least the thickness of the drain top. With a 7/64 inch thickness typical, the surface is elevated above the decking at least that amount causing puddling of water to occur along the length of the drain. Puddling or standing water is obviously undesirable in this situation since it causes spaulding of the concrete in areas of the country subject to freeze and thaw weather conditions.

OBJECTS OF THE INVENTION

It is therefore an object of the invention to provide a novel replacement re-cover drain top for a swimming pool deck drain able to avoid the side puddling associated with similar purpose re-cover tops of the prior art.

It is a further object of the invention to provide a novel replacement re-cover drain top of the previous object with a minimal and simple structural change over replacement re-cover structures previously employed to effectively eliminate the problem of side puddling.

It is a still further object of the invention to effect the replacement re-cover of the previous objects with a virtually costless change in the manufacturer of replacement re-cover drain tops.

SUMMARY OF THE INVENTION

This invention relates to a novel replacement re-cover drain top for refurbishing the deteriorated drain top of a set in-place swimming pool deck drain. More specifically, the invention relates to such a re-cover drain top of a construction that when installed, substantially if not completely, eliminates side puddling commonly associated with replacement re-cover drain tops of the type presently utilized.

For achieving the foregoing, the drain top re-cover hereof is constructed as a PVC strip of channel-shaped cross section having drain apertures in its upper surface. After the center portion of an existing drain has been removed, the strip when seated is adapted to overly the remaining drain with the longitudinal side faces of the channel inserted downward and intervening between the existing sidewalls of the remaining drain and the existing aggregate thereat. Unlike previous replacement re-cover drain tops, the drain apertures in the cover are disposed, not only in the top surface, but also in the side faces as well. With the depth of the drain apertures in the side faces being at least equal to the wall thickness of the top, the aperture entry to the drain top when installed are restored to the flush elevation of the original drain top. In this manner, side puddling is avoided as all drain water is permitted to enter through the re-cover top to the drain.

The above noted features and advantages of the invention as well as other superior aspects thereof will be further appreciated by those skilled in the art upon reading the detailed description that follows in conjunction with the drawings.

DESCRIPTION OF THE PREFERRED EMBODIMENT

Figure 1:
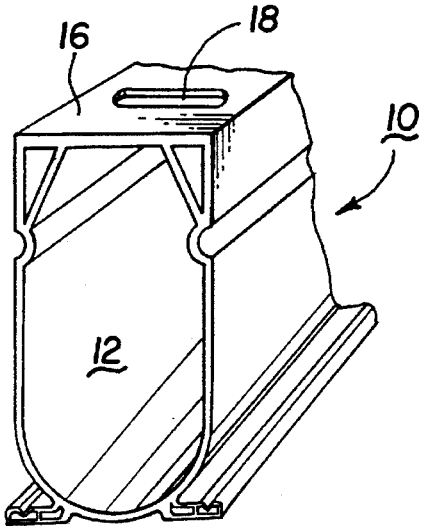
Fig. 1 (PRIOR ART)
FIG. 1 is an isometric view of an exemplary prior art swimming pool deck drain of a type with which the invention hereof is to be utilized.

In the description which follows, like parts are marked throughout the specification and drawings with the same reference numerals respectively. The drawing figures are not necessarily to scale and in certain views, parts may have been exaggerated for purposes of clarity.

Figure 2:
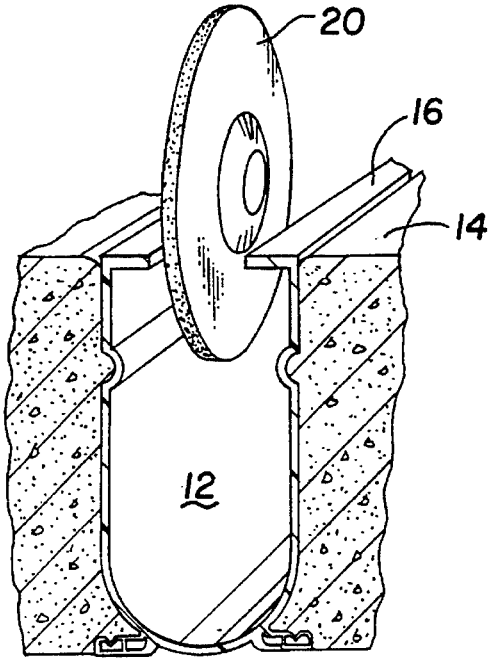
Fig. 2 (PRIOR ART)
FIG. 2 is an isometric view illustrating removal of a longitudinal center section of a deteriorated top in the drain of FIG. 1.

Referring now to FIGS. 1 and 2 of the drawings, there is illustrated a deck drain 10 of a type commercially available and integrally formed of PVC. The drain, when installed, includes a conduit cavity 12 positioned below the surface level of the adjacent decking 14 while the top surface 16 is disposed substantially flush therewith. Transverse apertures 18 permit decking drainage to enter the drain and be conducted through the conduit 12 to a suitable disposal site. Where the top surface 16 has deteriorated necessitating the refurbishing thereof, it is common to remove a longitudinal center portion thereof by means of a saw blade 20 in order to receive a replacement re-cover drain strip thereover as is well known. Following removal of the center strip, a gap 21 is defined thereat over which a re-cover strip is normally applied.

Referring now to FIGS. 3–7, there is shown the replacement re-cover drainage strip hereof designated 22, likewise formed of PVC in a channel-shaped cross section that includes a top wall 24 and opposite side walls 26 and 28. Formed in the top wall 24 are longitudinally spaced transverse drainage slots 30 extending into the sidewalls 26 and 28 to a depth "A" corresponding to at least the thickness of top wall 24 for reasons as will be understood.

Figure 3:
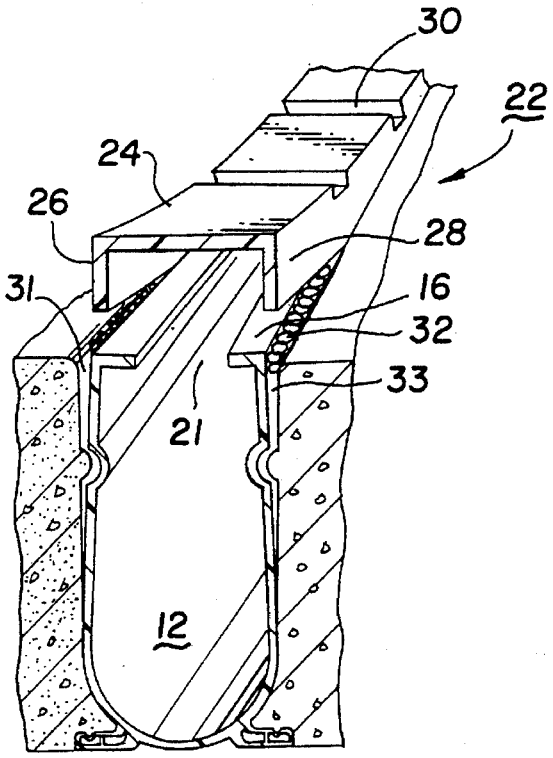
FIG. 3 is an isometric view illustrating the step of placing a replacement re-cover drain top of the invention hereof onto the drain of FIG. 2.
Figure 4:
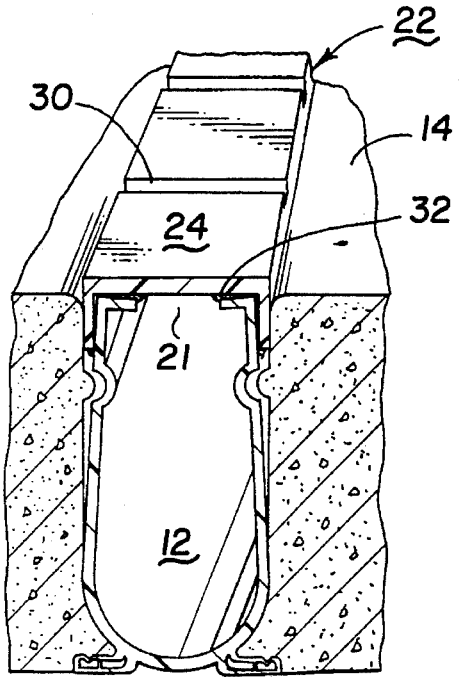
FIG. 4 is an isometric view of the installed re-cover drain top of FIG. 3.
Figure 5:
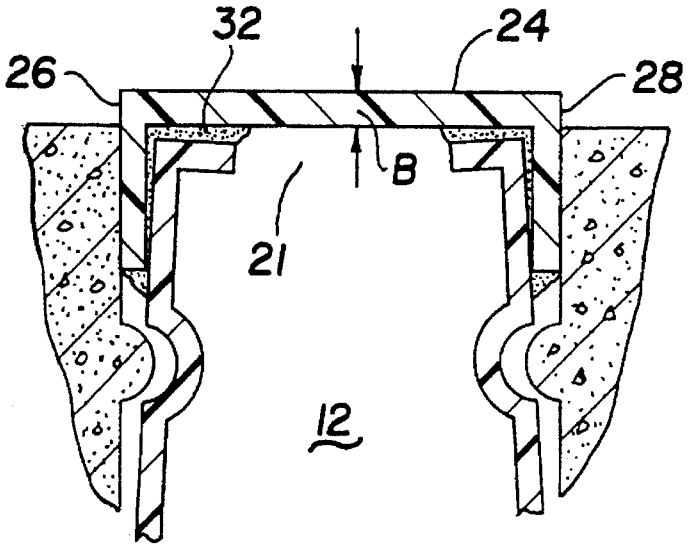
FIG. 5 is an enlarged fragmentary front elevation of the installed re-cover drain top of FIG. 4.
Figure 6:
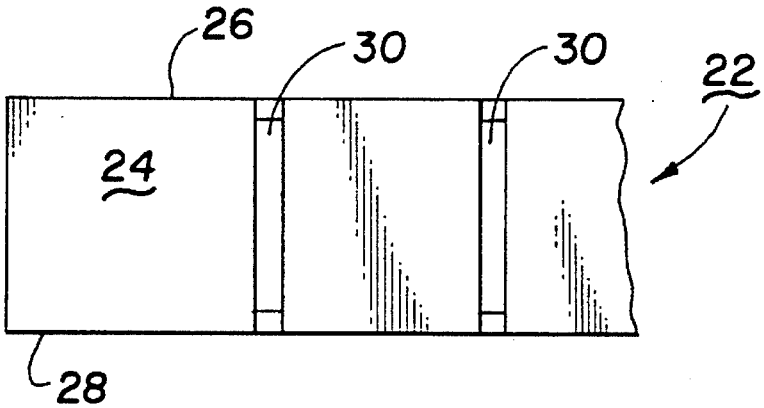
FIG. 6 is a fragmentary plan view of the re-cover drain top hereof.
Figure 7:
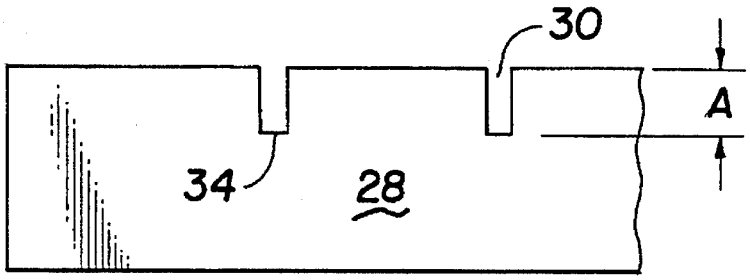
FIG. 7 is a fragmentary side elevation of the re-cover drain top hereof corresponding to FIG. 6.

With gap 21 defined in the drain top, the opposite sidewalls of the drain 10 at the level of top wall 16 can be urged together as best seen in FIG. 3, to form spacings 31 and 33 between the exterior of the side walls and the adjacent decking aggregate. After placing a quantity of sealant, such as silicone 32, in the spacings, the strip of re-cover drain top 22 is interfitted over the drain until seated whereby its sidewalls enter the spacings against the sealant for the strip to be fully superimposed, as best seen in FIG. 5. Slot dimension "A" in the sidewalls extend to a depth at least equal to the thickness dimension "B" of the top wall 24. A slighter greater dimension "A" than dimension "B" will allow for the anticipated sandwich thickness of compressed silicone 32. In this relation, the lower edge 34 of the sidewall slots will reside at a level flush with the surface of the adjacent decking 14. With the openings at level 34 being coincident with respect to the adjacent decking, all decking drainage will be readily routed into the apertures 30 without any side puddling being incurred.

By the above description there is disclosed a novel replacement re-cover drain top for refurbishing drain tops of existing PVC deck drains. With only a relatively simple yet effective structural change in the re-cover top, a long standing need of the industry has been readily resolved. The virtues thereof can be readily appreciated by those skilled in the art.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. A replacement re-cover drain top for refurbishing an integral deteriorated top cuttably removed at least partially from an existing drain conduit installed in the aggregate decking area about a swimming pool, said re-cover top comprising;

an elongated strip having a cross section adapted to be installed interfit in overlying cover relation to the existing drain from which at least a portion of deteriorated top has been cuttably removed; and drainage apertures in said strip adapted to receive drainage on said decking from at and above the flush level of the adjacent decking.

2. A replacement re-cover drain top in accordance with claim 1 in which said strip is a channel-like section including a top wall and oppositely spaced sidewalls that when installed in said interfit depend from above to below said flush level and said apertures extend through said sidewalls located when installed at and above said flush level.

3. A replacement re-cover drain top in accordance with claim 2 in which said apertures extend transversely continuous through said channel-like section including said side walls.

4. A replacement re-cover drain top in accordance with claim 3 in which said strip is adapted to straddle an existing drain when installed interfit thereon by said sidewalls depending between the exterior side surfaces of said existing drain and the adjacent decking aggregate thereat.

5. A replacement re-cover drain top in acordance with claim 3 in which the height of the apertures in said side walls below the upper surface of said top wall is at least equal to the thickness dimension of said top wall.

6. A replacement drain top in accordance with claim 5 in which there is included a sealant compressed between the underside of said top wall and the surface of an existing drain thereat and said side wall aperture height exceeds the thickness dimension of the top wall by at least the thickness of said sealant.

7. A system of replacement drain top re-cover for refurbishing an integral deteriorated top cuttably removed at least partially from an existing drain conduit installed in the aggregate decking area about a swimming pool, said system comprising:

an existing drain having a top surface generally flush with the adjacent decking and from which at least a protion of deteriorated top has been cuttably removed;

an elongated replacement re-cover top of cross section adapted to be installed interfit in overlying cover relation to said existing drain; and apertures in said replacement re-cover top adapted to receive drainage on said decking from at and above the flush level of the adjacent decking.

8. A system in accordance with claim 7 in which said replacement cover top is of a channel-like section including a top wall and oppositely spaced sidewalls that when installed in said interfit depend from above to below said flush level and said apertures extend through said sidewalls from at to above said flush level.

* * * * *